US009863603B2

(12) United States Patent
Oh et al.

(10) Patent No.: US 9,863,603 B2
(45) Date of Patent: Jan. 9, 2018

(54) HEADLIGHTS HAVING ONE LIGHT SOURCE MODULE FOR A HIGH BEAM AND A LOW BEAM

(71) Applicant: LG Electronics Inc., Seoul (KR)

(72) Inventors: Hong Lyeol Oh, Seoul (KR); Jun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 280 days.

(21) Appl. No.: 14/933,846

(22) Filed: Nov. 5, 2015

(65) Prior Publication Data

US 2016/0138780 A1 May 19, 2016

(30) Foreign Application Priority Data

Nov. 13, 2014 (KR) ..... 10-2014-0157804

(51) Int. Cl.

| | |
|---|---|
| ***F21V 9/14*** | (2006.01) |
| ***F21S 8/10*** | (2006.01) |
| *F21W 101/10* | (2006.01) |
| *F21Y 115/30* | (2016.01) |
| *F21Y 115/10* | (2016.01) |

(52) U.S. Cl.

CPC ..... *F21V 9/14* (2013.01); *F21S 48/114* (2013.01); *F21S 48/115* (2013.01); *F21S 48/1145* (2013.01); *F21S 48/1186* (2013.01); *F21S 48/1394* (2013.01); *F21S 48/1721* (2013.01); *F21W 2101/10* (2013.01); *F21Y 2115/10* (2016.08); *F21Y 2115/30* (2016.08)

(58) Field of Classification Search

CPC ..... F21V 9/14; F21S 48/114; F21S 48/1145; F21S 48/115; F21S 48/1186; F21S 48/1394; F21S 48/1721; F21Y 2115/30; F21Y 2115/10; F21W 2101/10

See application file for complete search history.

(56) References Cited

U.S. PATENT DOCUMENTS

| | | | | |
|---|---|---|---|---|
| 3,808,422 A * | 4/1974 | Handtmann | ..... | F21S 48/114 362/19 |
| 4,219,867 A * | 8/1980 | Zehender | ..... | F21S 48/114 359/485.04 |
| 7,484,864 B2 * | 2/2009 | Okada | ..... | F21S 48/119 362/297 |
| 2003/0202358 A1 | 10/2003 | Albou et al. | | |

FOREIGN PATENT DOCUMENTS

| | | | |
|---|---|---|---|
| JP | 2004-6344 | A | 1/2004 |
| JP | 2010-176981 | A | 8/2010 |
| KR | 10-1999-0001777 | A | 1/1999 |

* cited by examiner

*Primary Examiner* — Mary Ellen Bowman

(74) *Attorney, Agent, or Firm* — Birch, Stewart, Kolasch & Birch, LLP

(57) ABSTRACT

A high beam and a low beam is disclosed, the headlight including: a first light source unit; a second light source unit; a first light output unit; a second light output unit; and a controller configured to adjust a light quantity irradiated from the light source in response to a low beam mode or a high beam mode, and to control a beam output of the first light output unit and the second light output unit by allowing the first optical unit to be arranged selectively on a light path between the light source unit and the second optical unit.

20 Claims, 3 Drawing Sheets

HEADLIGHTS HAVING ONE LIGHT SOURCE MODULE FOR A HIGH BEAM AND A LOW BEAM

Pursuant to 35 U.S.C. §119 (a), this application claims the benefit of earlier filing date and right of priority to Korean Patent Application No. 10-2014-0157804, filed on Nov. 13, 2014, the contents of which are hereby incorporated by reference in their entirety.

BACKGROUND OF THE DISCLOSURE

Field

The teachings in accordance with the exemplary embodiments of this present disclosure generally relate to headlights having one light source module for a high beam and a low beam, and more particularly to headlights having one light source module for a high beam and a low beam configured to selectively operate a high beam or a low beam by changing a beam having a characteristic of linearly polarized light irradiated from a single light source unit to a circularly polarized light or to an elliptically polarized light, and outputting the beam to one path or two paths in response to a low beam mode or a high beam mode.

Background

A headlight of a vehicle called a head lamp is an illumination light having an essential function of lighting a front path in a night operation, and requires a brightness level capable of ascertaining a traffic obstacle located at a 100 meter ahead of a vehicle in a night operation, albeit there being a difference in terms of performance standard stipulated by each country.

In general, the headlight that lights in order to obtain a front view in a night travel of a vehicle is operated in a high beam (high beam mode) and a low beam (low beam mode), and when the vehicle is operated at a high speed, the vehicle selects a high beam to allow a beam irradiated from the headlight to be directed upwards, whereby a driver can recognize a far-out distance. When the vehicle is operated at a low speed, a low beam is selected to allow the beam irradiated from the headlight to direct downwards to prevent a driver view of an on-coming vehicle or a front vehicle from being obstructed.

To this end, left/right headlights of most vehicles currently consist of two-lighting type headlights with high beam and low beam lights, and commonly use dual filament bulbs, each bulb having a pair of high beam filament bulbs and a pair of low beam filament bulbs. Headlights on medium or higher class vehicles use four-lighting type headlights separately mounted with low beam light bulbs and high beam light bulbs.

The beams emitted from the low beam bulbs and high beam bulbs are reflected by a reflector mirror to be emitted to a front side of a vehicle and illuminate the front side of the vehicle by being adequately distributed.

However, the two-lighting type bulbs suffer from disadvantages in that lighting time is delayed due to repeated change of current between low beam bulbs and high beam bulbs to shorten the life of filaments, whereby a relevant lamp is not lighted when one of the filaments corresponding to the low beam bulbs or the high beam bulbs becomes out of order.

In order to solve the disadvantages thus mentioned, although a laser diode recently researched as one of light sources for headlights has an advantage of sending a beam of high brightness to a farther distance thanks to a smaller light emitting area, the laser diode suffers from various restrictions including a low JT (Junction Temperature, about 100° C.) as a vehicular part that requires reliability of high temperature.

It is therefore essential to constitute respective laser diode modules as many as the number of required light quantities in order to generate required light quantities for low beam bulbs and high beam bulbs respectively. Furthermore, the number of required modules must be minimized in order to save the cost, and to this end, the power applied to the laser diode must be maximally used, which however disadvantageously shortens the life due to increased JT of the laser diode. It is problematic that an inner temperature of a headlight is generally about 100° C., give or take.

SUMMARY OF THE DISCLOSURE

The present disclosure is provided to solve the aforementioned disadvantages/problems and it is an object of the present disclosure to provide headlights having one light source module for a high beam and a low beam configured to selectively operate a high beam or a low beam by changing a beam having a characteristic of linearly polarized light irradiated from a single light source unit to a circularly polarized light or to an elliptically polarized light, and outputting the beam to one path or two paths in response to a low beam mode or a high beam mode.

Technical problems to be solved by the present disclosure are not restricted to the above-mentioned descriptions, and any other technical problems not mentioned so far will be clearly appreciated from the following description by skilled in the art.

In one general aspect of the present disclosure, there is provided a headlight having one light source module for a high beam and a low beam, the headlight comprising:

- a light source unit configured to irradiate a first beam having a characteristic of linearly polarized light;
- a first optical unit configured to output as a second beam having a characteristic of a circularly polarized light or an elliptically polarized light when the first beam is incident;
- a second optical unit configured to output the first beam directly incident from the light source unit to a first path by projecting the first beam, to output a first component of the second beam incident from the first optical unit to the first path by separating the second beam and projecting the first component, and to output a second component to a second path by reflecting the second component;
- a first light output unit configured to output the beam provided from the first path to an outside;
- a second light output unit configured to output the beam provided from the second path to an outside; and
- a controller configured to adjust a light quantity irradiated from the light source in response to a low beam mode or a high beam mode, and to control a beam output of the first light output unit and the second light output unit by allowing the first optical unit to be arranged selectively on a light path between the light source unit and the second optical unit.

Preferably, but not necessarily, the first component of the second beam may be a P-polarized beam and the second component of second beam is an S-polarized beam.

Preferably, but not necessarily, the light source unit may include one or more of laser diodes, HID (High Intensity Discharge) lamps and LEDs.

Preferably, but not necessarily, the first optical unit may be configured to output as a second beam having a characteristic of a circularly polarized light or an elliptically polarized light by passing the first beam of linearly polarized blue light oscillated from the laser diode.

Preferably, but not necessarily, the controller may output a beam through the first light output unit and the second light output unit under a high beam mode, and output a beam only through the first light output unit in a low beam mode.

Preferably, but not necessarily, the second optical unit may output the second component of the second beam to the second path by reflecting the second component of the second beam to a right angle direction of the incident direction.

Preferably, but not necessarily, the first optical unit may be a ¼ wave plate. Preferably, but not necessarily, the ¼ wave plate may generate the circularly polarized light or the elliptically polarized light by adjusting a coating material, or adjusting an incident angle of polarization in response to adjustment of arrangement angle.

Preferably, but not necessarily, the second optical unit may be a PDF (Polarization Dichroic Filter) or a PBS (Polarization Beam Splitter).

Preferably, but not necessarily, the headlight may further comprise a position adjuster configured to change an arrangement of the first optical unit in response to control of the controller to allow the first optical unit to be selectively arranged on the light path between the light source and the second optical unit.

The first light output unit and the second light output unit may include a fluorescent material configured to convert a blue light outputted from the laser diode.

ADVANTAGEOUS EFFECTS OF THE DISCLOSURE

The present disclosure has an advantageous effect in that a high beam light and a low beam light can be driven by a single light source unit. As a result, fixtures, optical parts and the number of uses in cooling parts can be effectively reduced over a vehicle where light sources are respectively or separately mounted for a high beam light and a low beam light.

In addition, a current applied to a single light source unit mounted for driving a high beam mode can be relatively reduced to realize a low beam mode which has a high number of uses, whereby reliability can be enhanced by reducing the JT (Junction Temperature of a laser diode forming a light source unit.

DETAILED DESCRIPTION OF THE DISCLOSURE

Various aspects of the disclosure are described more fully hereinafter with reference to the accompanying drawings. This disclosure may, however, be embodied in many different forms and should not be construed as limited to any specific structure or function presented throughout this disclosure.

Unless otherwise defined, all terms (including technical and scientific terms) used herein have the same meaning as commonly understood by one of ordinary skill in the art to which this invention belongs. However, there are some terminologies arbitrarily selected by the applicant in particular instances, and in this case, the meanings thereof are explained in detail in the description of the Detailed Description, and therefore, this disclosure must be interpreted as having a meaning of the terminology which is not of a simple common terminology.

It will be understood that the terms "comprises" and/or "comprising,", "includes" and/or "including" when used in this specification, specify the presence of stated features, steps, operations, elements, and/or components, but do not preclude the presence or addition of one or more other features, steps, operations, elements, components, and/or groups thereof.

Figure 1:
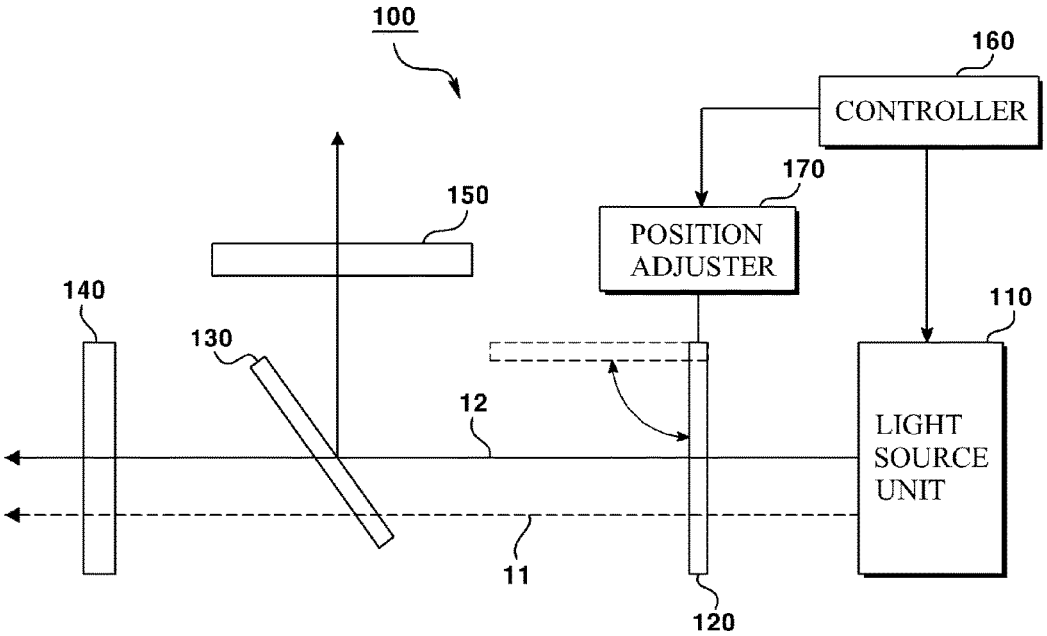
FIG. 1 is a schematic diagram illustrating a headlight having one light source module for a high beam and a low beam according to an exemplary embodiment of the present disclosure.

FIG. 1 is a schematic diagram illustrating a headlight (100) having one light source module for a high beam and a low beam according to an exemplary embodiment of the present disclosure.

Referring to FIG. 1, the headlight (100) having one light source module for a high beam and a low beam according to an exemplary embodiment of the present disclosure may include a light source unit (110), a first optical unit (120), a second optical unit (130), a first light output unit (140), a second light output unit (150), a controller (160) and a position adjuster (170).

The light source unit (110) may generate a beam. The light source unit (110) may be comprised of a single light source module. By way of example, the light source unit (110) may include one or more of laser diodes. The light source unit (110) may include one or more of HID (High Intensity Discharge) lamps. The light source unit (110) may include one or more of LEDs (Light Emitting Diodes).

The beam irradiated from the light source unit (110) may be set up to be adequate to a vehicle safety standard regulation of each country. By way of example, Korea stipulates a standard relative to a driving beam of a headlight, in a 'vehicle safety standard regulation', such as brightness per lamp, lamp color, light emitting surface, and brightness standard based on lamp type and light flux.

The beam irradiated from the light source unit (110) may have a characteristic of linearly polarized light. For the convenience of explanation, the beam irradiated from the light source unit (110) is defined as a first beam.

When the beam (first beam) is incident from the light source unit (110), the first optical unit (120) outputs the beam as a beam having a characteristic of a circularly polarized light or an elliptically polarized light. For the convenience of explanation, the beam irradiated from the first optical unit (120) is defined as a second beam.

The first optical unit (120) may output the beam as a second beam having a characteristic of a circularly polarized light or an elliptically polarized light by passing the first beam of polarized blue light oscillated from the light source unit (110) including a laser diode. The first optical unit (120) may include a QWP (Quarter Wave Plate).

The first optical unit (120) of ¼ (quarter) wave plate may generate the circularly polarized light or the elliptically polarized light by adjusting a coating material coated on the ¼ wave plate, or adjusting an incident angle of polarization in response to adjustment of arrangement angle. Thus, the light quantity through the first light output unit (140) and the light quantity of the second light output unit (150) by the first optical unit (120) under a high beam mode can be designed to be same. Furthermore, ratio of light quantity respectively required by the first light output unit (140) and the second light output unit (150) can be variably changed by adjusting the arrangement angle and coating materials of the first optical unit (120). At this time, the ratio of light quantity between the first light output unit (140) and the second light output unit (150) may be 50:50, 40:60, 30:70 or 20:80.

A first component of second beam outputted by the first optical unit (120) may be a P-polarized beam and the second component of second beam outputted by the first optical unit (120) may be an S-polarized beam.

The second optical unit (130) is installed between the first optical unit (120). The second optical unit (130) may project the first beam directly incident from the light source unit (110) and output to a first path facing the first optical output unit (140).

The second optical unit (130) may divide the second beam to a first component and a second component, when the second beam is incident from the first optical unit (120), and project the first component to an incidence progressing direction and output to a first path facing the first light output unit (140).

The second optical unit (130) may divide the second beam to a first component and a second component, when the second beam is incident from the first optical unit (120), and reflect from an incident surface of the second component and output to a second path facing the second light output unit (150). At this time, the second optical unit (130) reflect the second component of the second beam outputted from the first optical unit (120) to a direction perpendicular to an incident direction and output to a second path toward the second light output unit (150).

To this end, the second optical unit (130) may include a PDF (Polarization Dichroic Filter) or a PBS (Polarization Beam Splitter). When a first beam of straight polarization is incident, the second optical unit (130) including the PBS may pass the first beam as it is and output the first beam to the first light output unit (140). At this time, the second optical unit (130) may be so arranged as to allow a surface of the PBS to form a 45° relative to an incident direction of the second beam.

The first light output unit (140) may output a beam incident from the light source unit (110) sequentially through the first optical unit (120) and the second optical unit (130) to an outside. The first light output unit (140) may be so formed as to output all beams under a low beam mode and a high beam mode. Albeit not being illustrated, the first light output unit (140) may include a lens configured to collect a beam outputted from the second optical unit (130) through the first path, a reflector configured to adjust a direction of beam to a front surface of a vehicle, and an automatic axis adjuster configured to illuminate the beam to a ground by adjusting a beam output angle.

The second light output unit (150) may output the beam provided from the second optical unit (130) through the second path to an outside. Albeit not being illustrated, the second light output unit (150) may include a lens configured to collect a beam outputted from the second optical unit (130) through the second path, a reflector configured to adjust a direction of beam to a front surface of a vehicle, and an automatic axis adjuster configured to illuminate the beam to a ground by adjusting a beam output angle.

The low beam mode may be an operation mode of a headlight for operating a low beam light. The high beam mode may be an operation mode of a headlight for operating a high beam light. The beam may be outputted to an outside through the first light output unit (140) under the low beam mode, and the beam may not be outputted through the second light output unit (150). The beam is outputted to an outside through the first light output unit (140) and the second light output unit (150) under the high beam mode.

Reference numeral 11 in FIG. 1 indicates an output path of a beam under a low beam mode, and reference numeral 12 indicates an output path of a beam under the high beam mode.

The first light output unit (140) and the second light output unit (150) may include a fluorescent material configured to convert a blue light outputted from the light source unit (110) including a laser diamond to a white light. By way of example, the fluorescent material may include a yellow fluorescent material configured to convert a blue light outputted from the light source unit (110) including a laser diamond to a white light.

The controller (160) may adjust a light quantity irradiated by the light source unit (110) under a low beam mode or a high beam mode. The controller (160) may adjust the size of current applied to the light source unit (110) in order to adjust the light quantity irradiated by the light source unit (110). The controller (160) may control the light source unit (110) and the position adjuster (170) to allow the headlight to be operated in a low beam mode or a high beam mode in response to user input relative to an operation mode of the headlight.

When a low beam mode is set, the controller (160) may apply, to the light source unit (110), a first current of a size set up to the low beam mode. When a high beam mode is set, the controller (160) may apply, to the light source unit (110), a second current of a size set up to the high beam mode. At this time, size adjustment of first and second currents may be adequately set up in response to light quantity provided from the light source unit (110). The size of first current is smaller than that of the second current.

Thus, the life of the light source unit (110) can be prolonged because the beam mode takes a lion's share of operation time of the headlight over the high beam mode. In addition, the controller (160) may perform a control operation to selectively arrange the first optical unit (120) on a light path between the light source unit (110) and the second optical unit (130).

The position adjuster (170) may change an arrangement of the first optical unit (120) in response to the control of the controller (160) to allow the first optical unit (120) to be selectively arranged on a light path between the light source unit (110) and the second optical unit (130).

By way of example, the position adjuster (170) may rotate the first optical unit (120) about an arbitrary hinge axis. The position adjuster (170) may position the first optical unit (120) on a first position by rotating the first optical unit (120)

to be positioned on a light path between the light source unit (110) and the second optical unit (130). Meantime, the position adjuster (170) may position the first optical unit (120) on a second position by rotating the first optical unit (120) to be deviated from the light path between the light source unit (110) and the second optical unit (130).

In another modified exemplary embodiment, the position adjuster (170) may move the position of the first optical unit (120) through a moving guide (not shown). Thus, the position adjuster (170) can arrange the first optical unit (120) to a first position by moving the moving guide such that the first optical unit (120) can be positioned on a light path between the light source unit (110) and the second optical unit (130).

Meantime, the position adjuster (170) can position the first optical unit (120) on a second position through the moving guide such that the first optical unit (120) can be displaced from a light path between the light source unit (110) and the second optical unit (130). At this time, the moving direction may be left/right, or up/down or may be appropriately adjusted, as is necessitated.

Figure 2:
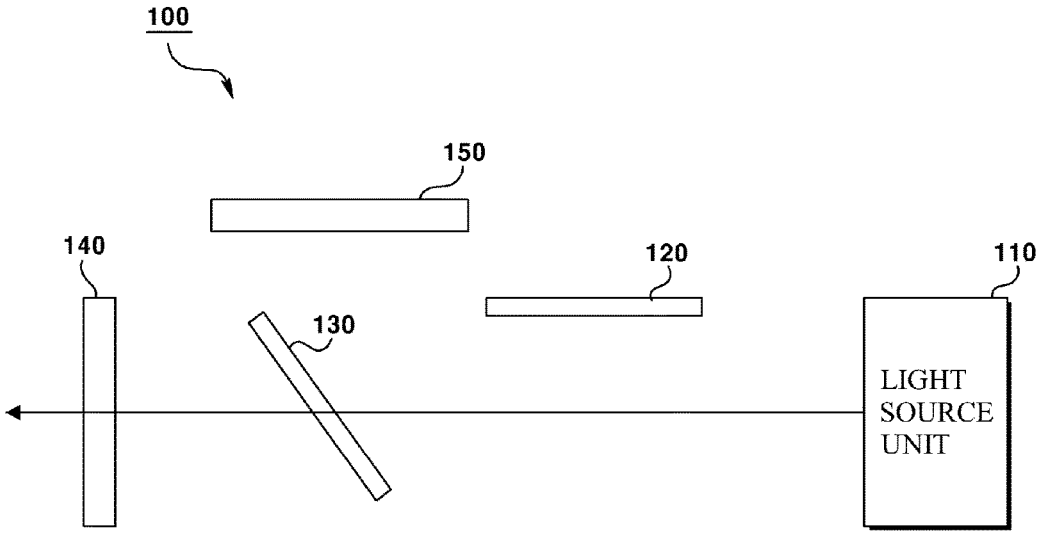
FIG. 2 is a schematic view illustrating a low beam mode in a headlight having one light source module for a high beam and a low beam according to an exemplary embodiment of the present disclosure.

FIG. 2 is a schematic view illustrating a low beam mode in a headlight (100) having one light source module for a high beam and a low beam according to an exemplary embodiment of the present disclosure.

Referring to FIG. 2, the headlight (100) having one light source module for a high beam and a low beam according to an exemplary embodiment of the present disclosure is operated in such a manner that a beam irradiated from the light source unit (110) can be outputted to an outside via the second optical unit (130) and the first light output unit (140), when an operation mode is set at a low beam mode out of a low beam mode and a high beam mode. The setting of low beam mode may be set by the controller (160). Note that FIG. 2 is not illustrated with the controller (160) and the position adjuster (170) in order to emphatically explain a light path according to the operation mode.

The first optical unit (120) may be arranged at a position deviated from a light path between the light source unit (110) and the second optical unit (130) under a low beam mode. The first optical unit (120) being arranged at a position deviated from a light path between the light source unit (110) and the second optical unit (130) may be realized by operation of the position adjuster (170). The position adjuster (170) may be operated in response to control of the controller (160) to move the first optical unit (120) to a positon set for the low beam mode by adjusting an arrangement position of the first optical unit (120).

When the operation mode is set at a low beam mode, the controller (160) may control a power supply unit (not shown) to allow a first current of a predetermined size to be supplied to the light source unit (110). The light source unit (110) may generate a beam of light quantity corresponding to that of the first current and output the beam by receiving the first current set by the controller (160) from the power supply unit (not shown). The beam irradiated from the light source unit (110) may have a characteristic of linear polarization. The light source unit (110) may output a first beam of polarized blue light oscillated when realized in a laser diode.

The second optical unit (130) may include a polarized beam distributor, such that the second optical unit (130) may project the first beam of linear polarization incident from the light source unit (110) and output the first beam to a first path facing the first light output unit (140). The first light output unit (140) may output the beam provided from the second optical unit (130) to an outside. At this time, the first light output unit (140) may output the beam to the outside using, albeit not being illustrated, a lens configured to collect the beam, a reflector configured to adjust a direction of the beam to a front side of a vehicle or an automatic axis adjuster configured to illuminate a ground by adjusting a beam output angle. At this time, beams incident from the light source unit (110) to the second optical unit (130) are all outputted to the first light output unit (140) and therefore are not outputted to the second light output unit (150).

Figure 3:
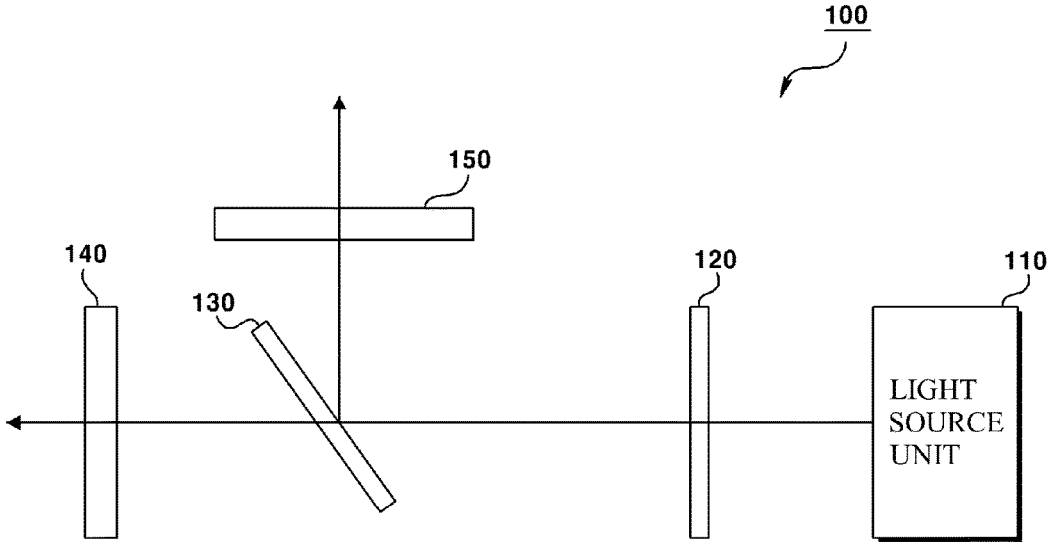
FIG. 3 is a schematic view illustrating a high beam mode in a headlight having one light source module for a high beam and a low beam according to an exemplary embodiment of the present disclosure.

FIG. 3 is a schematic view illustrating a high beam mode in a headlight (100) having one light source module for a high beam and a low beam according to an exemplary embodiment of the present disclosure.

Referring to FIG. 3, the headlight having one light source module for a high beam and a low beam according to an exemplary embodiment of the present disclosure may be operated to output a beam irradiated from the light source unit (110) to an outside via the first optical unit (120), the second optical unit (130), the first light output unit (140) and the second light output unit (150), when an operation mode is set at a high beam mode. The setting of high beam mode is realized by the controller (160).

Note that FIG. 3 is not illustrated with the controller (160) and the position adjuster (170) in order to emphatically explain a light path according to the operation mode.

The first optical unit (120) may be arranged to be positioned at a light path between the light source unit (110) and the second optical unit (130) under a high beam mode. The first optical unit (120) being arranged to be positioned at a light path between the light source unit (110) and the second optical unit (130) may be realized by operation of the position adjuster (170). The position adjuster (170) may be operated in response to control of the controller (160) to move the first optical unit (120) to a positon set for the high beam mode by adjusting an arrangement position of the first optical unit (120).

When the operation mode is set at a high beam mode, the controller (160) may control a power supply unit (not shown) to allow a second current of a predetermined size to be supplied to the light source unit (110). The light source unit (110) may generate a beam of light quantity corresponding to that of the second current and output the beam by receiving the second current set by the controller (160) from the power supply unit (not shown). The beam irradiated from the light source unit (110) may have a characteristic of linear polarization. The light source unit (110) may output a first beam of polarized blue light oscillated when realized in a laser diode.

When a beam (the first beam) of linear polarization is incident from the light source unit (110), the first optical unit (120) may output the beam as a beam (second beam) having a characteristic of a circularly polarized light or an elliptically polarized light. The first optical unit (120) may project the first beam of blue polarized light realized by laser diode and oscillated from the light source unit (110) and output as a second beam having a characteristic of a circularly polarized light or an elliptically polarized light. By way of example, the first optical unit (120) may be configured by a ¼ wave plate. Thus, a first component of the second beam outputted from the first optical unit (120) may be a P-polarized beam and a second component of second beam outputted from the first optical unit (120) may be an S-polarized beam.

The second optical unit (130) may project the first component by separating the second beam incident through the first optical unit (120) and output to a first path facing the first light output unit (140). Meantime, the second optical unit (130) may separate the second beam incident from the first optical unit (120) to project the first component, and output to a second path facing the second light output unit (150) by reflecting the second component of the second beam to a right angle direction of the incident direction.

The first light output unit (140) may output, to an outside a P-polarized beam corresponding to the first component of the second beam provided from the second optical unit (130). At this time, the first light output unit (140) may output the beam to the outside using, albeit not being illustrated, a lens configured to collect the beam, a reflector configured to adjust a direction of the beam to a front side of a vehicle or an automatic axis adjuster configured to illuminate a ground by adjusting a beam output angle.

The second light output unit (150) may output, to an outside, an S-polarized beam provided through the second path from the second optical unit (130). The second light output unit (150) may include, albeit not being illustrated, a lens configured to collect the beam, a reflector configured to adjust a direction of the beam to a front side of a vehicle or an automatic axis adjuster configured to illuminate a ground by adjusting a beam output angle.

Figure 4:
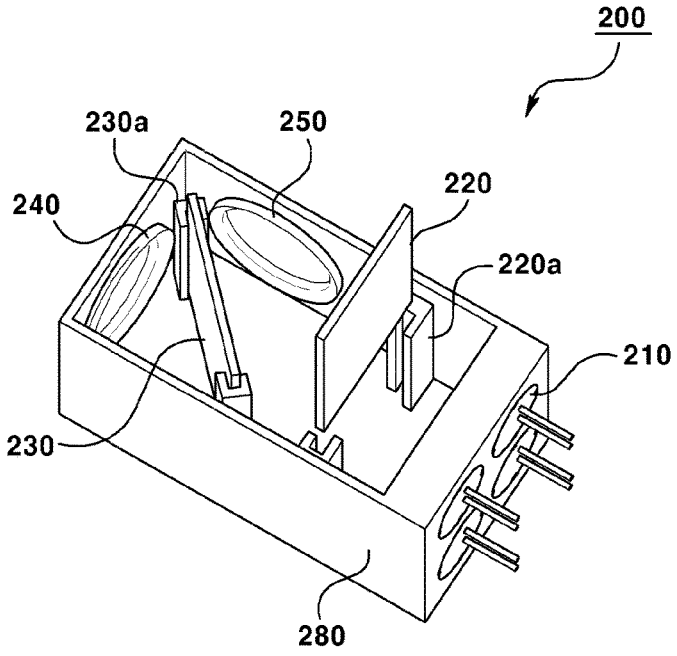
FIG. 4 is a schematic conceptual view illustrating a low beam mode in a headlight having one light source module for a high beam and a low beam according to another exemplary embodiment of the present disclosure.

FIG. 4 is a schematic conceptual view illustrating a low beam mode in a headlight (200) having one light source module for a high beam and a low beam according to another exemplary embodiment of the present disclosure.

Referring to FIG. 4, the headlight (200) having one light source module for a high beam and a low beam according to another exemplary embodiment of the present disclosure may be configured in a manner such that a light source unit (210), a first optical unit (220), a first light output unit (240) and a second light output unit (250) are mounted at a housing (280).

Note that FIG. 4 is not illustrated with the controller and the position adjuster illustrated in FIG. 1 in order to emphatically explain an operation according to an operation mode.

The first optical unit (220) may be arranged to be positioned at a light path between the light source unit (210) and the second optical unit (230) through a moving guide (220*a*). The moving guide (220*a*) may be variably changed in shape and position, and a moving direction of the first optical unit (220) may be left/right, or up/down or may be appropriately adjusted, as is necessitated.

The second optical unit (230) may be inserted into a guide groove (230*a*) and mounted at a housing (280) by being positioned at a front surface of the first light output unit (240) and the second light output unit (250), At this time, the second optical unit (230) may be inserted into the guide groove (230*a*) to have an angle of 45° relative to a progressing direction of a beam incident from the light source unit (210). At this time, the first optical unit (220) may be arranged at an outside of the housing (280) through the moving guide (220*a*) to allow the first optical unit (220) to be deviated from a light path between the light source unit (210) and the second optical unit (230). Although the first optical unit (220) is illustrated to be suspended in the air in the drawing, this drawing is provided to help understand the configuration, and a separate support unit may be actually installed to support the first optical unit (230).

When the operation mode is set at a low beam mode, the operation may be so performed as to allow a beam irradiated from the light source unit (210) to be outputted to an outside through the second optical unit (230) and the first light output unit (240).

As illustrated in FIG. 4, the first optical unit (220) may be arranged to be placed at a position deviated from a light path between the light source unit (210) and the second optical unit (230) under a low beam mode.

The light source unit (210) may generate a beam (a first beam) of light quantity corresponding to that of a first current and output the beam by receiving the first current from a power supply unit (not shown). The beam irradiated from the light source unit (210) may have a characteristic of linear polarization. The light source unit (210) may output a first beam of polarized blue light oscillated when realized in a laser diode.

The second optical unit (230) may include a polarized beam distributor, such that the second optical unit (230) may project the first beam of linear polarization incident from the light source unit (210) and output the first beam to a first path facing the first light output unit (240). The first light output unit (240) may output the beam provided from the second optical unit (230) to an outside. At this time, the first light output unit (240) may output the beam to the outside using, albeit not being illustrated, a lens configured to collect the beam, a reflector configured to adjust a direction of the beam to a front side of a vehicle or an automatic axis adjuster configured to illuminate a ground by adjusting a beam output angle. At this time, beams incident from the light source unit (210) to the second optical unit (130) are all outputted to the first light output unit (240) and therefore are not outputted to the second light output unit (250).

Figure 5:
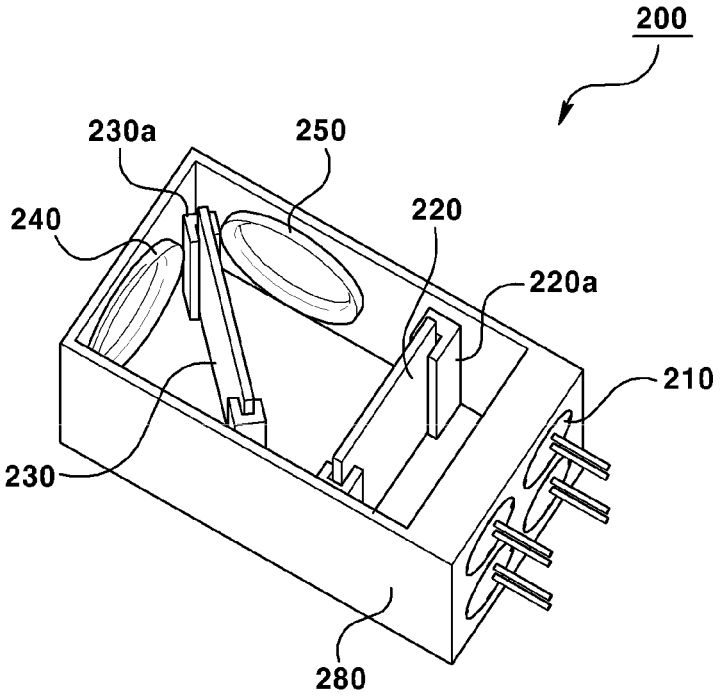
FIG. 5 is a schematic conceptual view illustrating a high beam mode in a headlight having one light source module for a high beam and a low beam according to another exemplary embodiment of the present disclosure.

FIG. 5 is a schematic conceptual view illustrating a high beam mode in a headlight having one light source module for a high beam and a low beam according to another exemplary embodiment of the present disclosure.

Referring to FIG. 5, the headlight (200) having one light source module for a high beam and a low beam according to another exemplary embodiment of the present disclosure may be configured in a manner such that a light source unit (210), a first optical unit (220), a first light output unit (240) and a second light output unit (250) are mounted at a housing (280).

Note that FIG. 5 is not illustrated with the controller and the position adjuster illustrated in FIG. 1 in order to emphatically explain an operation according to an operation mode.

The first optical unit (220) may be arranged to be placed at a light path between the light source unit (210) and the second optical unit (230) through a moving guide (220*a*). The moving guide (220*a*) may be variably changed in shape and position, and a moving direction of the first optical unit (220) may be left/right, or up/down or may be appropriately adjusted, as is necessitated.

The second optical unit (230) may be inserted into a guide groove (230*a*) and mounted at a housing (280) by being positioned at a front surface of the first light output unit (240) and the second light output unit (250), At this time, the second optical unit (230) may be inserted into the guide groove (230*a*) to have an angle of 45° relative to a progressing direction of a beam incident from the light source unit (210). At this time, the first optical unit (220) may be arranged at an inside of the housing (280) through the moving guide (220*a*) to allow the first optical unit (220) to be placed at a light path between the light source unit (210) and the second optical unit (230).

When the operation mode is set at a high beam mode, the operation may be so performed as to allow a beam irradiated from the light source unit (210) to be outputted to an outside through the first optical unit (220), the second optical unit (230), the first light output unit (240) and the second light output unit (250).

When the operation mode is set at a high beam mode, a controller may control a power supply unit (not shown) to allow a second current of a predetermined size to be supplied to the light source unit (210). The light source unit (210) may generate a beam of light quantity corresponding to that of the second current and output the beam by receiving the second current from the power supply unit (not shown). The beam irradiated from the light source unit (210) may have a characteristic of linear polarization. The light source unit (110) may output a first beam of polarized blue light oscillated when realized in a laser diode.

When a beam (the first beam) of linear polarization is incident from the light source unit (210), the first optical unit (220) may output the beam as a beam (second beam) having a characteristic of a circularly polarized light or an elliptically polarized light. The first optical unit (220) may pass the first beam of blue polarized light realized by laser diode and oscillated from the light source unit (210) and output as a second beam having a characteristic of a circularly polarized light or an elliptically polarized light. By way of example, the first optical unit (220) may be configured by a ¼ wave plate. Thus, a first component of the second beam outputted from the first optical unit (220) may be a P-polarized beam and a second component of second beam outputted from the first optical unit (220) may be an S-polarized beam.

The second optical unit (230) may project the first component by separating the second beam incident through the first optical unit (220) and output to a first path facing the first light output unit (240). Meantime, the second optical unit (230) may separate the second beam incident from the first optical unit (220) to reflect the second component to a right angle direction of the incident direction, and output to a second path facing the second light output unit (250).

The first light output unit (240) may output, to an outside a P-polarized beam corresponding to the first component of the second beam provided from the second optical unit (230). At this time, the first light output unit (240) may output the beam to the outside, using, albeit not being illustrated, a lens configured to collect the beam, a reflector configured to adjust a direction of the beam to a front side of a vehicle or an automatic axis adjuster configured to illuminate a ground by adjusting a beam output angle.

The second light output unit (250) may output, to an outside, an S-polarized beam provided through the second path from the second optical unit (230). The second light output unit (250) may include, albeit not being illustrated, a lens configured to collect the beam, a reflector configured to adjust a direction of the beam to a front side of a vehicle or an automatic axis adjuster configured to illuminate a ground by adjusting a beam output angle.

Although the present disclosure has been described in detail with reference to the foregoing embodiments and advantages, many alternatives, modifications, and variations will be apparent to those skilled in the art within the metes and bounds of the claims. Therefore, it should be understood that the above-described embodiments are not limited by any of the details of the foregoing description, unless otherwise specified, but rather should be construed broadly within the scope as defined in the appended claims

What is claimed is:

1. A headlight having one light source module for a high beam and a low beam, the headlight comprising:

a light source unit configured to irradiate a first beam having a characteristic of linearly polarized light;

a first optical unit configured to output as a second beam having a characteristic of a circularly polarized light or an elliptically polarized light when the first beam is incident;

a second optical unit configured to output the first beam directly incident from the light source unit to a first path by projecting the first beam, to output a first component of the second beam incident from the first optical unit to the first path by separating the second beam and projecting the first component, and to output a second component to a second path by reflecting the second component;

a first light output unit configured to output the beam provided from the first path to an outside;

a second light output unit configured to output the beam provided from the second path to an outside; and a controller configured to adjust a light quantity irradiated from the light source unit in response to a low beam mode or a high beam mode, and to control a beam output of the first light output unit and the second light output unit by allowing the first optical unit to be arranged selectively on a light path between the light source unit and the second optical unit.

2. The headlight of claim 1, wherein the first component of the second beam is a P-polarized beam and the second component of second beam is an S-polarized beam.

3. The headlight of claim 1, wherein the light source unit includes one or more of laser diodes, HID (High Intensity Discharge) lamps and LEDs.

4. The headlight of claim 3, wherein the first optical unit is configured to output as a second beam having a characteristic of a circularly polarized light or an elliptically polarized light by passing the first beam of linearly polarized blue light oscillated from the laser diode.

5. The headlight of claim 1, wherein the controller outputs a beam through the first light output unit and the second light output unit under a high beam mode, and output a beam only through the first light output unit in a low beam mode.

6. The headlight of claim 1, wherein the second optical unit outputs the second component of the second beam to the second path by reflecting the second component of the second beam to a right angle direction of the incident direction.

7. The headlight of claim 1, wherein the first optical unit is a ¼ wave plate.

8. The headlight of claim 7, wherein the ¼ wave plate generates the circularly polarized light or the elliptically polarized light by adjusting a coating material, or adjusting an incident angle of polarization in response to adjustment of arrangement angle.

9. The headlight of claim 1, wherein the second optical unit is a PDF (Polarization Dichroic Filter) or a PBS (Polarization Beam Splitter).

10. The headlight of claim 1, further comprising a position adjuster configured to change an arrangement of the first optical unit in response to control of the controller to allow the first optical unit to be selectively arranged on the light path between the light source unit and the second optical unit.

11. A headlight having one light source module for a high beam and a low beam, the headlight comprising:

a light source unit;

a first optical unit configured to convert a light incident from the light source to a circularly polarized light or an elliptically polarized light and output the converted light;

a second optical unit configured to project the light incident from the light source unit, and to output the circularly polarized light or the elliptically polarized light by projecting or reflecting the circularly polarized light or the elliptically polarized light in response to polarization component;

a first light output unit configured to output the light projected from the second optical unit to an outside;

a second light output unit configured to output the light reflected from the second optical unit to an outside; and a controller configured to adjust a light quantity irradiated from the light source in response to a low beam mode or a high beam mode, and to control a position of the first optical unit so as to allow the first optical unit to be arranged selectively on a light path between the light source unit and the second optical unit.

12. The headlight of claim 11, wherein the second optical unit projects a P-polarized light and reflects an S-polarized light.

13. The headlight of claim 11, wherein the light source unit includes one or more of laser diodes, HID (High Intensity Discharge) lamps and LEDs.

14. The headlight of claim 13, wherein the first optical unit is configured to output a linearly polarized blue light oscillated from the laser diode by converting the linearly polarized blue light to a circularly polarized light or an elliptically polarized light while allowing the linearly polarized blue light to pass.

15. The headlight of claim 11, wherein the controller controls in a manner such that the first optical unit is positioned on a light path of the light source unit and the second optical unit under the high beam mode.

16. The headlight of claim 11, wherein the controller controls in a manner such that the first optical unit is not positioned on a light path between the light source unit and the second optical unit under the low beam mode.

17. The headlight of claim 12, wherein the second optical unit outputs the S-polarized light to the second light output unit by reflecting the S polarized light to a right angle direction.

18. The headlight of claim 11, wherein the first optical unit is a ¼ wave plate.

19. The headlight of claim 18, wherein the ¼ wave plate generates the circularly polarized light or the elliptically polarized light by adjusting a coating material, or adjusting an incident angle of polarization in response to adjustment of arrangement angle.

20. The headlight of claim 11, wherein the second optical unit is a PDF (Polarization Dichroic Filter) or a PBS (Polarization Beam Splitter).

* * * * *